US006027578A

United States Patent [19]

Marzano

[11] Patent Number: 6,027,578

[45] Date of Patent: Feb. 22, 2000

[54] NON-CHROME CONVERSION COATING

[75] Inventor: Michael Marzano, Concord, Ohio

[73] Assignee: Pavco, Inc., Cleveland, Ohio

[21] Appl. No.: 09/094,262

[22] Filed: Jun. 9, 1998

[51] Int. Cl.[7] ..... C23C 22/00

[52] U.S. Cl. ..... 148/243; 148/274; 148/283

[58] Field of Search ..... 148/243, 274, 148/277, 279, 283

[56] References Cited

U.S. PATENT DOCUMENTS

| | | | |
|---|---|---|---|
| 24,604 | 6/1859 | Pomeroy | 148/274 |
| 2,502,441 | 4/1950 | Dodd et al. | 148/243 |
| 3,966,902 | 6/1976 | Chromecek | 252/108 |
| 3,975,214 | 8/1976 | Kulick et al. | 148/6.15 R |
| 4,017,334 | 4/1977 | Matsushima et al. | 148/6.15 R |
| 4,039,353 | 8/1977 | Kulick et al. | 148/6.15 R |
| 4,298,404 | 11/1981 | Greene | 148/6.14 A |
| 4,529,626 | 7/1985 | Baker et al. | 427/226 |
| 4,828,615 | 5/1989 | Cape | 106/14.13 |
| 4,944,812 | 7/1990 | Lindert et al. | 148/251 |
| 5,039,770 | 8/1991 | Lindert et al. | 526/312 |

*Primary Examiner*—Prince Willis
*Assistant Examiner*—Andrew L. Oltmans
*Attorney, Agent, or Firm*—Fay, Sharpe, Fagan, Minnich & McKee, LLP

[57] ABSTRACT

A chrome-free conversion coating composition for use over zinc-plated metal comprises a combination of a transition metal oxide, and a polyhydroxy aromatic to provide a coating that eliminates environmental concerns regarding chromium disposal. Aluminum chlorohydrol is also included in the composition to provide an aesthetically pleasing blue appearance. The conversion coating composition is combined with water to form a bath. Zinc plated metal is immersed in the bath to apply the coating.

16 Claims, No Drawings

NON-CHROME CONVERSION COATING

BACKGROUND OF THE INVENTION

This invention pertains to the art of metal surface treatment and, more particularly, to conversion coatings for plated metals.

The invention is particularly applicable to treatment or passivation of zinc-plated metal surfaces using a non-chrome conversion coating and will be described with particular reference thereto. However, it will be appreciated that the invention has broader applications such as treatment of other types of plated or non-plated substrates.

In the metal finishing industry, conversion coatings are used to provide metal surfaces with improved corrosion resistance. Conversion coatings also provide metal surfaces with improved adhesion for additional coatings such as paint or other finishes. A widely used conversion coating uses chromate. Such chromate conversion coatings are applied at various thicknesses, ranging from a very thin "blue-bright" finish to a very thick olive-drab finish. "Blue-bright" finishes are transparent with a slight blue tint and high luster. Such a finish not only imparts a corrosion-resistant coating to the surface of a substrate but also aesthetically enhances the substrate and articles made therefrom. Heavier chromate conversion coatings are considerably more protective than the bright finishes, but they do not meet the aesthetic criteria that are characteristic of the bright coatings. These heavier coatings are well-recognized by their yellow, bronze, or olive-drab finishes which are listed in general order of increasing film thickness.

Although conversion coating techniques using chrome provide satisfactory results, the techniques are undesirable because they necessarily include baths containing toxic hexavalent or trivalent chromium. Such chromium baths require special treatment before they can be disposed of. Therefore, the waste from the chromium based solutions raises grave environmental concerns that make their disposal prohibitive.

There are non-chrome treatments that form passivation coating but these are unsatisfactory for enhancing the corrosion resistance of a plated substrate, especially when the treated substrate is subjected to a moist environment. Such inferior treatments include phosphating treatments and treatments that have a bright dipping step followed by a coating step using a transparent lacquer. Each treatment provides only a barrier to corrosive conditions rather than an adhesive and cohesive film formed by chemical means between a film-forming element and a plated coating. Further, phosphating treatments provide barriers that are porous permitting moisture to pass through to the plated coating. Phosphating treatment coatings are not bright in appearance, but provide dull, opaque paint-like overcoats lacking the aesthetic attributes of chromium conversion coatings. Treatments that coat a bright-dipped article with a transparent lacquer typically use water emulsifiable polymer coatings that break down when wetted. Consequently, moisture penetrates to the bright dipped film, discoloring and diminishing its initial bright appearance.

Therefore, it has been deemed desirable to provide a chromium-free conversion coating that has the attributes of a traditional chromium conversion coating. Such a chromium-free system should be, as does a blue bright chromate conversion coating, impervious to and passive to moisture and pass a standard salt spray test for up to about 12 to 24 hours or more, while simultaneously enhancing the appearance of the substrate by imparting an attractive, brightly polished finish thereto. Such surfaces also should be more receptive to paint than the untreated plated surface.

An object of the present invention is to provide a conversion coating composition that does not contain hexavalent or trivalent chromium in order to eliminate the need for specialized waste treatment.

Another object of the present invention is to provide a conversion coating composition that results in an aesthetically pleasing finish.

Another object of the present invention is to provide a coating that offers a desirable level of salt spray protection.

The present invention contemplates a new and improved conversion coating composition which overcomes the above referenced problems and others and provides a coating which is chrome free, aesthetically pleasing, and corrosion inhibiting.

SUMMARY OF THE INVENTION

In accordance with the present invention there is provided a conversion coating composition comprising a polyhydroxy aromatic and an oxide of a transition metal.

In accordance with a more limited aspect of the invention, the polyhydroxy aromatic acid is tannic acid.

In accordance with a still more limited aspect of the invention, the oxide of a transition metal is vanadium pentoxide.

In accordance with another aspect of the invention, a method for applying a conversion coating onto an article comprises the steps of immersing the article in a conversion coating bath comprising water, a polyhydroxy aromatic, and an oxide of a transition metal and rinsing the article.

In accordance with a more limited aspect of the invention, the method further comprises the step of plating the article with zinc prior to the application of the conversion coating.

An advantage of the invention is that it eliminates the need for chrome reduction of the waste generated from conversion coating operations.

Another advantage of the invention is that the composition provides for an aesthetically pleasing blue bright finish on plated metal without the need for chromium in the composition.

Another advantage of the invention is that the composition provides a desirable level of corrosion resistance as evidenced by salt spray protection tests.

Still another advantage of the invention is that it provides an adherent and coherent surface onto a zinc substrate which surface is impervious and passive to moisture and withstands mildly corrosive media and which surface readily accepts paint or other coatings.

Still further advantages of the present invention will become apparent to those of ordinary skill in the art upon a reading of the following detailed description of the preferred embodiments.

DETAILED DESCRIPTION OF THE PREFERRED EMBODIMENT

The present invention is directed to non-chrome conversion coatings for use over electro-deposited zinc metal. The conversion coating can be used over both alkaline non-cyanide and chloride zinc plating systems. The coating contains no hexavalent or trivalent chromium. The present coating provides corrosion protection equal to most hexavalent chromate systems, but without the chrome.

In a typical metal treatment operation employing a composition and process of the present invention, an ironcontaining alloy such as steel is electroplated with zinc. After plating, the plated metal is rinsed, bright dipped in a mild inorganic acid, dipped in a bath of the conversion coating, then rinsed and finally dried.

More particularly, after zinc plating, the plated metal is rinsed twice with water and then dipped in a 0.5% to 1% nitric acid solution for 5 to 20 seconds. The step of dipping in nitric acid is necessary with alkaline non-cyanide plating systems, but may be omitted in chloride zinc systems. After these steps, the cleaned plated metal is immersed in a dilution of the conversion coating composition of the present invention. The coated metal is then hot rinsed in water at 120° F. to 140° F. and dried.

The conversion coating is comprised of film forming agents, buffers, pH controllers, stabilizers, and film polishers. For ease of manufacturing, storage and transportation, the conversion coating is produced in concentrated form. The general composition of the concentrated form of the conversion coating is provided in the following table:

| | Range (Mole/L) | Preferred Range (Mole/L) |
|---|---|---|
| Nitrate ions | $8.82 \times 10^{-2}$ to 4.41 | $8.82 \times 10^{-1}$ to 1.76 |
| Sulfate ions | $1.06 \times 10^{-2}$ to $8.45 \times 10^{-1}$ | $2.67 \times 10^{-2}$ to $5.28 \times 10^{-1}$ |
| Sulfamic Acid | $1.54 \times 10^{-2}$ to 1.00 | $6.18 \times 10^{-2}$ to $6.18 \times 10^{-1}$ |
| Boric Acid | $1.94 \times 10^{-2}$ to 1.18 | $1.21 \times 10^{-1}$ to $8.49 \times 10^{-1}$ |
| Tannic Acid | $4.41 \times 10^{-4}$ to $4.41 \times 10^{-2}$ | $3.53 \times 10^{-3}$ to $3.09 \times 10^{-2}$ |
| Aluminum Chlorohydrol | $8.60 \times 10^{-3}$ to $6.02 \times 10^{-1}$ | $3.44 \times 10^{-2}$ to $4.73 \times 10^{-1}$ |
| Fluoride ions | $6.13 \times 10^{-3}$ to 1.83 | $1.29 \times 10^{-2}$ to $6.10 \times 10^{-1}$ |
| Vanadium Pentoxide | $2.75 \times 10^{-4}$ to $8.20 \times 10^{-2}$ | $4.40 \times 10^{-4}$ to $4.95 \times 10^{-2}$ |
| Nitric Acid | 0.0 to 1.57 | $3.14 \times 10^{-1}$ to 1.10 |

The nitrate and sulfate ions both function as film formers on the zinc plated surface. The sulfamic acid acts as a buffer and controls the pH of the solution. Boric acid, also a buffer, enhances the stability of the solution.

In the present invention, tannic acid aids in film formation and corrosion protection. Tannic acid or polyhydroxy benzoic acid ($C_{76}H_{52}O_{46}$) is a light brown powder often used for dyeing and tanning. Generally, tannic acid is incompatible with oxidizing substances.

The addition of aluminum chlorohydrol provides an aesthetically desirable blue color and contributes to film formation. Aluminum chlorohydrol, aluminum chlorohydrate, or aluminum hydroxychloride $Al_2(OH)_5Cl_2 \cdot 5H_2O$ is an inorganic cationic polymer often used to solidify clay soils in oil well drilling operations.

In the present invention, vanadium pentoxide aids in film formation and corrosion protection. Vanadium pentoxide is a yellow or rust-brown crystalline substance frequently used to inhibit ultraviolet light transmission in glass.

Sodium bifluoride is a film polisher, and nitric and sulfamic acids control acidity and pH.

The concentrated form of the conversion coating composition is diluted before immersion of metal articles therein. Specifically, a bath of the conversion coating is prepared using a clean tank. The tank or the tank lining should be made from a material inert to the conversion coating such as polyethylene, polyvinyl chloride (PVC), or stainless steel. Clean, 70° F. to 100° F. water is added to the tank to about 95% of its working volume. Then, while mixing, 1.0% to 6.0% of the working volume of the tank is filled with the concentrated form of the conversion coating composition. Finally, the rest of the working volume of the tank is filled with water. In the preferred embodiment of the invention, the pH of the bath of conversion coating composition, i.e., the diluted form of the composition, is in the range from 2.0 to 2.8. In other embodiments of the invention, the immersion bath may be made using 1.0% to 3.0% of the concentrated conversion coating composition.

The plated articles are dipped in the bath of conversion coating composition at a temperature of 70° F. to 100° F. for about 15 to 60 seconds. The articles are then rinsed in water, then rinsed a second time in water heated to 120° F. to 140° F. Following rinsing, the articles are dried.

The novel combination of polyhydroxy aromatics and transition metal oxides provides the primary benefits of the conversion coating of the present invention. Tannic acid as the polyhydroxy aromatic and vanadium pentoxide as the metal oxide are preferable. However, it is to be appreciated that other polyhydroxy aromatics or substituted polyhydroxy aromatics such as resorcinol, catechol, hydroquinone may be used. Similarly, other transition metal oxides may be used such as oxides of molybdenum, zirconium, titanium and tungsten. Further, other metal salts known for film formation may be substituted for the transition metal oxide, e.g., salts of transition metals such as molybdenum, zirconium, titanium and tungsten.

In U.S. Pat. No. 4,039,353, Kulick et al teach post-treatment of conversion-coated metal surfaces using a combination of melamine-formaldehyde resin with vegetable tannin. This combination is applied after the conversion coating. In contrast, the present invention uses no resin in its conversion coating composition. Further, corrosion inhibition is achieved in the present invention using a conversion coating without a post-treatment coating. It should be noted that application of a tannin containing composition to a chromium based coating, as disclosed in Kulick et al., destroys the tannin. This results because of the oxidation strength of the hexavalent chromium ion. In contrast, vanadium used in the present invention is a weaker oxidant that does not affect polyhydroxy aromatics.

To prove the anti-corrosion effects of the conversion coating of the present invention, salt spray or fog testing was performed according to the standards of the American Society for Testing and Materials (ASTM) designation B 117-90. The testing apparatus consisted of a fog chamber, a salt solution reservoir, a supply of suitably conditioned compressed air, and atomizing nozzles. Using the apparatus, salt solution comprised of 5 parts by weight sodium chloride in 95 parts of water was sprayed onto zinc-plated steel specimens for prolonged periods to cause corrosion. The temperature in the chamber was maintained at 95° F. The onset of two types of corrosion were documented: white salts and red rust. In the tests, zinc-plated steel specimens treated with the conversion coating of the present invention remained corrosion free until well after corrosion formed on untreated (control) specimens. Further, the length of time before corrosion appeared on the treated specimens was in the same range as for specimens treated with typical conversion coatings containing hexavalent chrome and trivalent chrome run simultaneously.

The invention has been described with reference to the preferred embodiment. Obviously modifications and alterations will occur to others upon a reading and understanding of this specification. It is intended to include all such modifications and alterations insofar as they come within the scope of the appended claims or the equivalent thereof.

Having thus described the preferred embodiment, the invention is now claimed:

1. A conversion coating composition comprising:

a polyhydroxy aromatic, an oxide of a transition metal, and aluminum chlorohydrol.

2. The conversion coating composition of claim 1 wherein the polyhydroxy aromatic is tannic acid.

3. The conversion coating composition of claim 1 wherein the oxide of a transition metal is vanadium pentoxide.

4. The conversion coating composition of claim 1 wherein the composition is in a concentrated form comprising:

a) approximately $4.41\times10^{-4}$ to $4.41\times10^{-2}$ mole/L of the polyhydroxy aromatic; and b) approximately $2.75\times10^{-4}$ to $8.20\times10^{-2}$ mole/L of the transition metal oxide.

5. The conversion coating composition of claim 4 wherein the composition is in a concentrated form comprising:

a) approximately $3.53\times10^{-3}$ to $3.09\times10^{-2}$ mole/L of the polyhydroxy aromatic; and b) approximately $4.40\times10^{-4}$ to $4.95\times10^{-2}$ mole/L of the transition metal oxide.

6. The conversion coating composition of claim 1 wherein the composition is in a diluted form having a pH in a range of about 2.0 to 2.8.

7. The conversion coating composition of claim 1 further comprising:

a film forming agent;

a stabilizer;

a pH controller; and a buffer.

8. The conversion coating composition of claim 7 wherein the film forming agent is one of sodium nitrate and sodium sulfate, wherein the stabilizer is boric acid, wherein the buffer is one of boric acid and sulfamic acid, and wherein the pH controller is one of sulfamic acid and nitric acid.

9. The conversion coating composition of claim 7 further comprising:

a film polisher.

10. The conversion coating composition of claim 9 wherein the film polisher is sodium bifluoride.

11. A concentrated conversion coating composition comprising:

about $4.41\times10^{-4}$ to $4.41\times10^{-2}$ to mole/L tannic acid;

about $2.75\times10^{-4}$ to $8.20\times10^{-2}$ mole/L vanadium pentoxide;

a blue bright agent;

a film forming agent;

a buffer; and a pH control agent.

12. The conversion coating composition of claim 11 wherein the tannic acid is present in the amount approximately $3.53\times10^{-3}$ to $3.09\times10^{-2}$ mole/L and the vanadium pentoxide is present in the amount of approximately $4.40\times10^{-4}$ to $4.95\times10^{-2}$ mole/L.

13. The conversion coating composition of claim 11 further comprising a film polisher.

14. The conversion coating composition according to claim 12 wherein the blue bright agent is about $8.60\times10^{-3}$ to $6.02\times10^{-1}$ mole/L aluminum chlorohydrol, wherein the film forming agent is one of sodium nitrate and sodium sulfate, wherein the buffer is one of boric acid and sulfamic acid, wherein the pH controller is one of sulfamic acid and nitric acid, and wherein the film polisher is sodium bifluoride.

15. A method for applying a conversion coating onto an article comprising the steps of:

immersing the article in a conversion coating bath comprising water, a polyhydroxy aromatic, an oxide of a transition metal and aluminum chlorohydrol;

plating the article with zinc prior to the step of immersing the article; and rinsing the article.

16. The method according to claim 15 wherein the bath is at a temperature of 70° F. to 100° F., wherein the step of immersing is for about 15 to 60 seconds and wherein the step of rinsing includes hot rinsing in water at a temperature of 120° F. to 140° F.

* * * * *